United States Patent [19]

Arcidiacono

[11] 4,074,904

[45] Feb. 21, 1978

[54] SWIMMING WORKOUT SUIT

[76] Inventor: Agostino Arcidiacono, 8838 La Jolla Scenic Drive, La Jolla, Calif. 92037

[21] Appl. No.: 729,105

[22] Filed: Oct. 4, 1976

[51] Int. Cl.[2] ..... A63B 21/00

[52] U.S. Cl. ..... 272/116; 9/301

[58] Field of Search ..... 9/301, 302, 303, 311, 9/329, 336, 334, 400; 272/1 B, 71, 116, 119

[56] References Cited

U.S. PATENT DOCUMENTS

| | | | |
|---|---|---|---|
| 1,480,366 | 1/1924 | Bergerson | 9/302 |
| 3,517,930 | 6/1970 | Jacobsen | 9/303 X |
| 3,584,870 | 6/1971 | Garst | 272/71 X |

*Primary Examiner*—Galen L. Barefoot

[57] ABSTRACT

A belt shaped swimming workout suit for the purpose of increasing the water drag upon the body of swimmers during training and workouts. The suit is provided with vanes which are hand adjustable so that water drag can be set according to the desire of most swimmers.

2 Claims, 3 Drawing Figures

SWIMMING WORKOUT SUIT

BACKGROUND OF THE INVENTION

The instant invention relates to various means used by competitive swimmers to artificially increase water drag in order to develop muscular power for their various strokes. There are various well known conventional methods used by swimmers for increasing water drag ranging from pull-buoys, tubes, heavy fabric or multiple suits, T-shirts, cut-off jeans, to full-drag suits. The most common of these methods, the pull-buoys method, consists of two interconnected and buoyant cylinders generally held by the swimmer within his inner thighs. A drag plate is generally added to this device for increasing water drag. This method does not allow the swimmer to use his legs and less yet to make flip turns. It also affects the swimmer's attitude and buoyance. The other methods and especially drag suits, affect the body attitude and buoyance because of the extra weight; they also interfere with the swimmer natural and efficient stroke movements and make breathing more difficult.

SUMMARY OF THE INVENTION

The instant invention provides swimmers with an improved version of the above mentioned methods. The majority of these methods interfere with the normal stroke movements of the swimmer, flip turns, body attitude, buoyance and regular breathing. The instant invention provides swimmers with means for setting and thus tailoring the amount of desirable water drag according to their own muscular strength and without interfering with the basic stroke movements.

DETAILED DESCRIPTION OF THE PREFERRED EMBODIMENT

Figure 1:
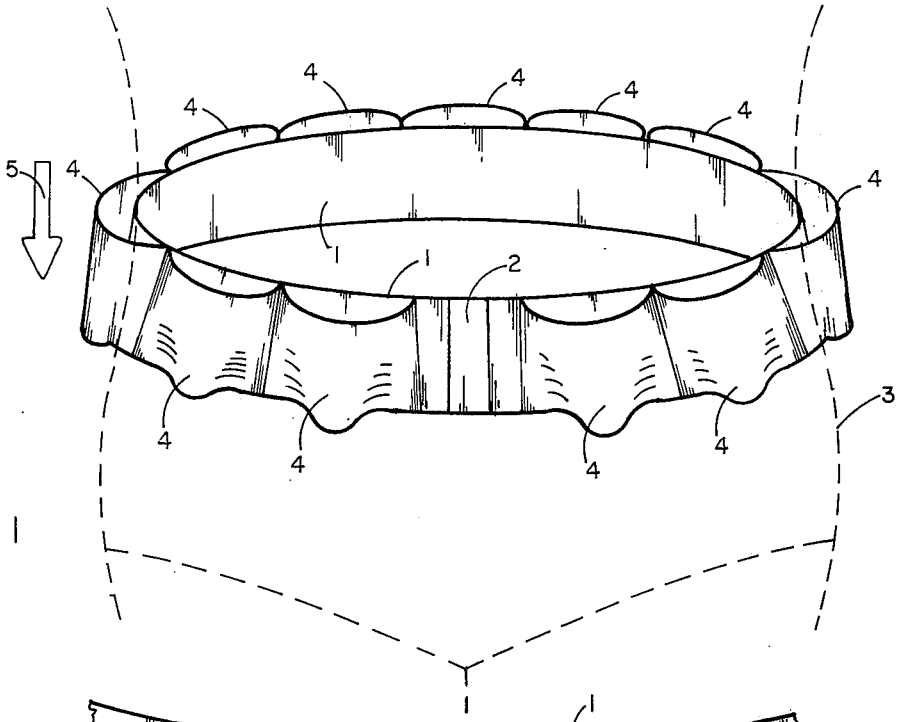
FIG. 1 shows a schematic presentation of the apparatus of the invention including a belt equipped with a plurality of adjustable drag vanes and an outline of the swimmer body waistline.

FIG. 1 shows generally a schematic representation of the instant invention and includes a belt 1 secured by common means 2 to the swimmer's body waistline 3 shown with a broken line. A plurality of vanes 4 are disposed and secured upon said belt 1 and are oriented along the water flow direction shown by arrow 5.

Figure 2:
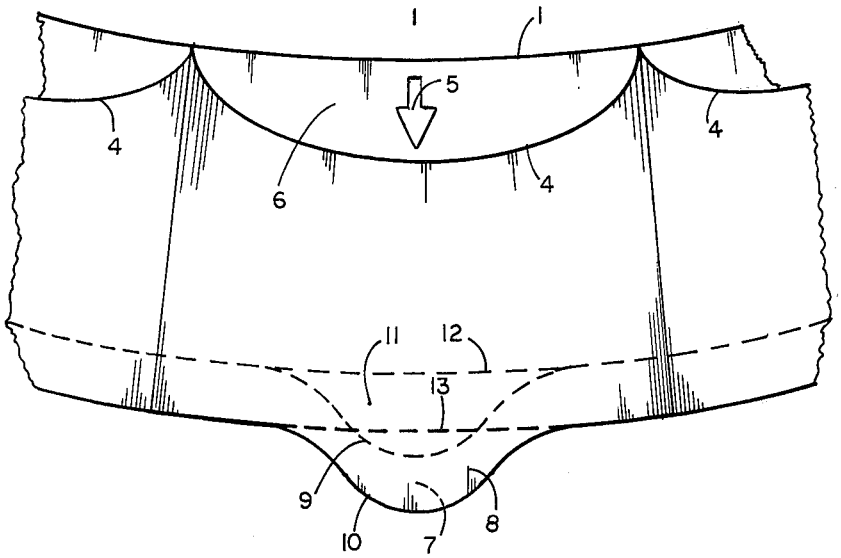
FIG. 2 shows a schematic presentation of the apparatus of the invention including the detail of a vane and of the means for controlling the water flow through it and thus the drag.

FIG. 2 shows a detailed view of one of the vanes 4 provided with a primary aperture 6 to let the water flow in and a secondary aperture 7 to let the water out. The primary aperture 6 is substantially fixed in size while the secondary aperture 7 is adjustable in size to control the flow rate through its vane and thus the water drag. The border 8 of the secondary aperture 7, outlined by the curved broken line 9 and curved solid line 10, is provided with means to match and adhere to opposite border 11 outlined by the broken lines 12 and 13. Border 11 is part of the belt 1 and it is provided with means to match and adhere to the correspondent and opposite border 8. Border 11 follows the contour and surface of the swimmer body while border 8 does not so that an opening of the desired size can be left to restrict and control the flow of the water through the vane.

Figure 3:
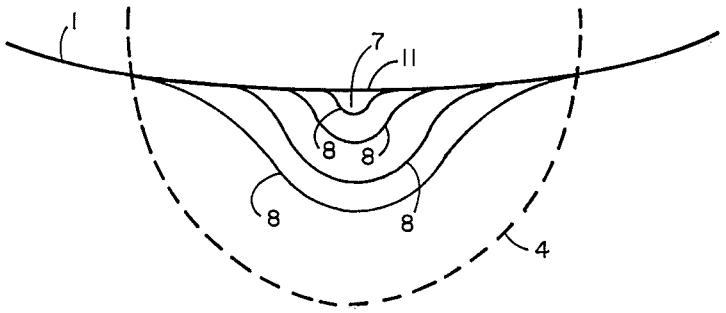
FIG. 3 shows a schematic presentation of the apparatus of the invention including the detail of a vane outflow aperture shown at various settings, when seen in the direction of the water flow in the vicinity of the means for controlling and setting the size of the aperture.

FIG. 3 shows in detail various setting of adherence between border 8 of vane 4 and border 11 of belt 1 when seen from the top of the vane and in the direction of the water flow 5. A substantially continuous adjustment of secondary aperture 7 is possible and thus of the water drag through each vane. The workout suit described herein and constructed according to the invention is relatively simple and comfortable to wear and does not interfere with the basic movements of the various strokes, and the body's attitude or buoyance.

The invention may be embodied in other specific forms without departing from the spirit or essential characteristics thereof. The present embodiment is therefore to be considered in all aspects illustrative and not restrictive, the scope of the invention being indicated by the appended claims rather than by the foregoing description, and all changes which come within the meaning and range of equivalence of the claims are therefore intended to be embraced therein.

What is claimed and desired to be secured by United States Letters Patent is:

1. A swimming workout suit comprising in combination:

a primary belt shaped surface;

a secondary belt shaped surface substantially of the same width and longer than said primary surface;

said secondary surface flatly joined to said primary surface at selected intervals forming a plurality of open ended substantially semi-cylindrical vanes in a integral structure;

said vanes formed by the outer wall of said primary surface and by the inner wall of said secondary surface;

said vanes disposed around said suit and oriented in the direction of the swimmer motion;

said walls forming a fixed size inlet aperture at one end of said vane and an adjustable size outlet aperture at the other end of said same vane;

said adjustable aperture provided with means to match and adhere selected portions of the terminal border of said secondary surface with that of the primary surface and thereby selectively control the water flow through said vane and the resistance provided by said vane;

means associated with said belt shaped suit primary surface ends to secure said suit around a swimmer body.

2. The invention defined in claim 1 additionally comprising a conventional swimming suit attached thereto.

* * * * *